US006834430B2

(12) United States Patent
Worrell

(10) Patent No.: US 6,834,430 B2
(45) Date of Patent: Dec. 28, 2004

(54) METHOD OF MAKING TWO-PART KNOB

(75) Inventor: James L. Worrell, DeKalb, IL (US)

(73) Assignee: K I Industries, Inc., Berkeley, IL (US)

( * ) Notice: Subject to any disclaimer, the term of this patent is extended or adjusted under 35 U.S.C. 154(b) by 0 days.

(21) Appl. No.: 10/699,496

(22) Filed: Oct. 31, 2003

(65) Prior Publication Data

US 2004/0088828 A1 May 13, 2004

Related U.S. Application Data

(62) Division of application No. 10/151,386, filed on May 20, 2002, now Pat. No. 6,687,957.

(51) Int. Cl.[7] ..... B21K 23/00; A45C 13/22; E05B 3/00

(52) U.S. Cl. ..... 29/896.5; 29/450; 29/453; 29/451; 29/460; 29/458; 16/433; 16/414; 292/351; 292/DIG. 2

(58) Field of Search ..... 29/458, 460, 450, 29/453, 451, 896.5; 16/414, 417, 421, 433, 441, 351; 74/553; 292/347, DIG. 2, 348, 351

(56) References Cited

U.S. PATENT DOCUMENTS

| | | | | | |
|---|---|---|---|---|---|
| 449,908 | A | | 4/1891 | Matthews | |
| 461,175 | A | | 10/1891 | Turner | |
| 482,954 | A | * | 9/1892 | Wilmot | 292/347 |
| 665,534 | A | * | 1/1901 | Lawson | 292/347 |
| 1,305,619 | A | | 6/1919 | Pond | |
| 1,837,720 | A | | 12/1931 | Luce et al. | |
| 2,216,467 | A | * | 10/1940 | Falk | 292/347 |
| 2,425,611 | A | | 8/1947 | Frost et al. | |
| 2,430,727 | A | * | 11/1947 | Morgen | 292/347 |
| 2,517,803 | A | * | 8/1950 | Seaholm | 292/347 |
| 2,632,540 | A | * | 3/1953 | Smith | 192/46 |
| 2,788,236 | A | | 4/1957 | Kafowi | |
| 2,797,592 | A | * | 7/1957 | Marrapese | 74/548 |
| 3,410,247 | A | * | 11/1968 | Dronberger | 116/311 |
| 3,648,394 | A | * | 3/1972 | Hepner | 40/331 |
| 4,082,351 | A | | 4/1978 | Chrones | |
| 4,213,416 | A | * | 7/1980 | Klingler | 116/309 |
| 4,604,786 | A | | 8/1986 | Howie, Jr. | |
| 4,608,882 | A | * | 9/1986 | Howie, Jr. | 74/548 |
| 4,751,038 | A | | 6/1988 | Schlueter et al. | |
| 4,796,329 | A | | 1/1989 | Bory | |
| 5,033,168 | A | | 7/1991 | Sbragi | |
| 5,316,355 | A | * | 5/1994 | Hartwell et al. | 292/347 |
| 5,499,427 | A | | 3/1996 | Bowman | |
| 5,509,174 | A | * | 4/1996 | Worrell | 16/441 |
| 6,242,064 | B1 | | 6/2001 | Howie, Jr. | |

FOREIGN PATENT DOCUMENTS

| | | |
|---|---|---|
| GB | 2046192 A | 11/1980 |

* cited by examiner

*Primary Examiner*—Marc Jimenez
(74) *Attorney, Agent, or Firm*—Wood, Phillips, Katz, Clark and Mortimer

(57) ABSTRACT

An appliance knob has a polymeric body, which is molded, and a metal cup, which is made by stamping and drawing a metal sheet or a metal strip. The polymeric body has a central boss, which has an end face, a cylindrical wall, and an annular recess encompassing the central boss and having an annular floor. The cylindrical wall adjoins the annular floor. The metal cup, which is adapted to fit over the central boss, has a circular plate covering the end face top of the central boss and a cylindrical skirt encompassing the cylindrical wall of the central boss. The cylindrical skirt is unitary with the circular plate. The metal cup is secured to the polymeric body via two unitary tabs, which project through associated slots in the annular floor and coact with the polymeric body, as well as adhesively.

10 Claims, 2 Drawing Sheets

METHOD OF MAKING TWO-PART KNOB

CROSS-REFERENCE TO RELATED APPLICATION

This application is a division of U.S. patent application Ser. No. 10/151,386, which was filed on May 20, 2002 now U.S. Pat. No. 6,687,957.

TECHNICAL FIELD OF THE INVENTION

This invention pertains to a knob, such as an appliance knob, of a type having a polymeric part and a metal part, which is secured to the polymeric part and which has an outer surface that may be a finished, decorative, or indicia-bearing surface. This invention also pertains to a method of making such a knob.

BACKGROUND OF THE INVENTION

Knobs of the type noted above are used widely for kitchen appliances, for entertainment devices, such as radios and television sets, and in diverse other applications. Commonly, the metal part of such a knob is an aluminum plate, which may be circular and which is secured adhesively to the polymeric part. Commonly, the outer surface of the metal part of such a knob may be finished, as by brushing or engine-turning, or may be decorated, as by enameling or anodizing, and may be an indicia-bearing surface.

U.S. Pat. No. 4,604,786 exemplifies a method of making a knob of the type noted above, wherein a machined apron of the metal part is removed except for two tabs, which are inserted into slots in the polymeric part, whereupon the tabs are bent inwardly to secure the metal part to the polymeric part.

SUMMARY OF THE INVENTION

This invention provides an improved knob, such as an appliance knob, of the type noted above. The improved knob has a polymeric body, which has a boss having an end face and having a wall. The polymeric body has a recess bordering the boss and having a floor, which the wall adjoins. The knob has a metal cup fitting over the boss. The metal cup has a plate covering the end face of the boss and a skirt bordering the wall of the boss and being unitary with the plate. The metal cup is secured to the polymeric body.

Preferably, the skirt has a unitary tab projecting from the skirt, into an associated slot in the floor, and being used to secure the metal cup to the polymeric body. The unitary tab may be one of two unitary tabs functioning similarly. In some contemplated embodiments, each unitary tab has a barbed portion, which coacts with the polymeric body to secure the metal cup to the polymeric body. In another contemplated embodiment, each unitary tab has a terminal portion, which is bent under the polymeric body to secure the metal cup to the polymeric body. In any contemplated embodiment, the plate may be also secured adhesively to the top of the central boss.

This invention also provides a method of making the improved knob. A polymeric material is molded to provide the polymeric knob, as described above. A metal sheet or a metal strip is stamped and drawn to provide the metal cup, as described above. The metal cup is secured, as described above, to the polymeric body.

Although polypropylene is preferred for the polymeric knob, another engineering polymer may be instead used. Although aluminum is preferred for the metal cup, stainless steel, chrome-plated steel, or any other suitable metal may be instead used.

DETAILED DESCRIPTION OF THE ILLUSTRATED EMBODIMENTS

Figure 1:
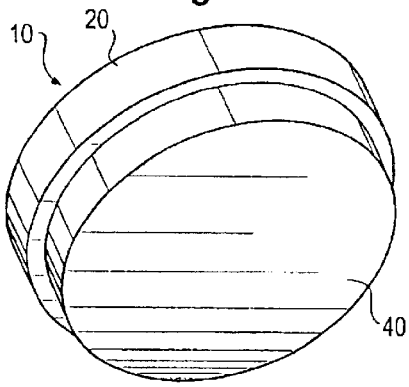
FIG. 1 is a perspective view of an appliance knob comprising a polymeric body and a metal cup and constituting a preferred embodiment of this invention.
Figure 2:
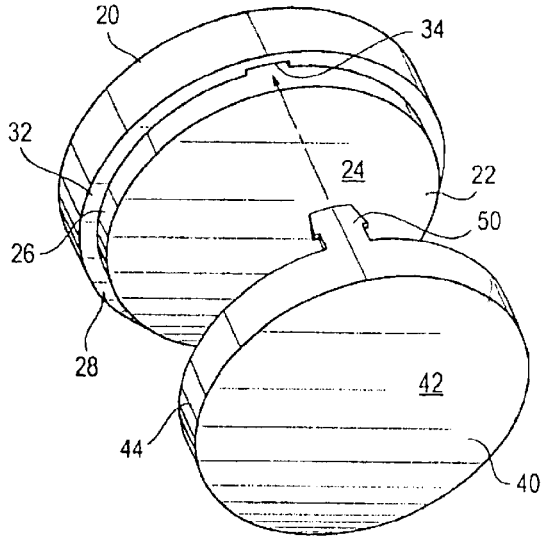
FIG. 2 is an exploded, perspective view of the polymeric body and the metal cup, before the metal cup is secured to the polymeric body, in one contemplated manner, to provide the appliance knob of FIG. 1.

As illustrated in FIG. 1, an appliance knob 10 of the type noted above comprises a molded, polypropylene body 20 and a drawn, aluminum cup 40. As illustrated in FIG. 2, the polypropylene body 20 is molded so as to have a cylindrical boss 22 having an end face 24, which is circular, and a cylindrical wall 26, and so as to have an annular recess 28 bordering the cylindrical wall 26 and having an annular floor 32, which the cylindrical wall 26 adjoins.

Figure 3:
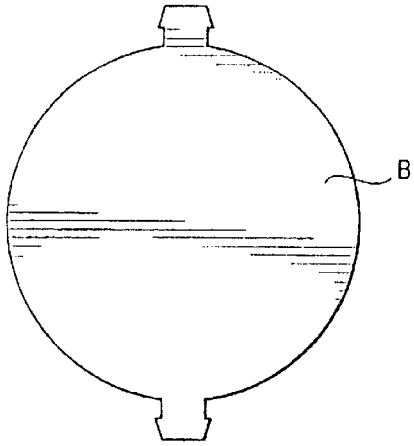
FIG. 3 is a plan view of a blank, which is drawn to provide the metal cup of FIGS. 1 and 2.
Figure 11:
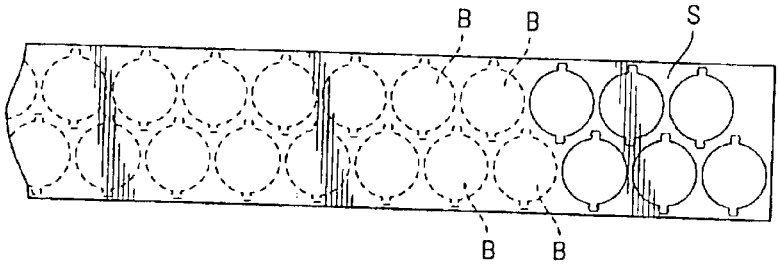
FIG. 11 is a plan view of a metal strip, from which a series of blanks like the blank of FIG. 3 are stamped, whereby to leave a series of apertures in the metal strip.

The aluminum cup 40 is drawn from a blank B, as exemplified in FIG. 3, which is one of a series of similar blanks B stamped from an aluminum strip S, as exemplified in FIG. 11. As illustrated in FIG. 2, the aluminum cup 40 has a circular plate 42 and a cylindrical skirt 44, which is unitary to the circular plate 42 and from which two unitary tabs 50 project axially.

When the polypropylene body 20 and the aluminum cup 40 are assembled to provide the appliance knob 10, the aluminum cup 40 fits over the cylindrical boss 22, the circular plate 42 covering the end face 24 and the cylindrical skirt 44 bordering the cylindrical wall 26, and each unitary tab 50 projects axially through an associated slot 34 in the polypropylene body 20 and is used to secure the aluminum cup 40 to the polypropylene body 20.

Figure 4:
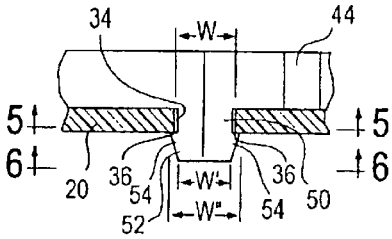
FIG. 4 is a fragmentary, cross-sectional detail of one unitary tab of the metal cup of FIGS. 1 and 2, the unitary tab projecting through an associated slot in the polymeric body, whereby the metal cup is secured to the polymeric body.
Figure 5:
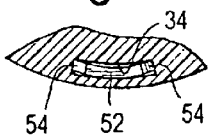
FIGS. 5 and 6 respectively are fragmentary, cross-sectional details, as taken along lines 5—5 and 6—6 respectively in FIG. 4, in directions indicated by arrows.
Figure 6:
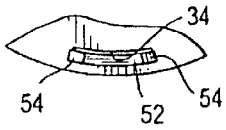

In the preferred embodiment illustrated in FIGS. 2, 3, and 4, each unitary tab 50 has a barbed portion 52 having two opposite barbs 54, which are beveled. As illustrated in the FIGS. 5 and 6, the associated slot 34 is shaped so as to cause the barbed portion 52 to curl slightly about a central axis of the aluminum cup 40, as the barbed portion 52 is pushed into and through the associated slot 34, and so as to permit the barbed portion 52 to uncurl, after the barbed portion 52 has been pushed through the associated slot 34, until the opposite barbs 54 bear against two opposite margins 36 of the associated slot 34 so as to secure the aluminum cup 40 to the polypropylene body 20. Thus, in the comparative dimensions indicated in FIG. 4, W'<W<W".

Figure 7:
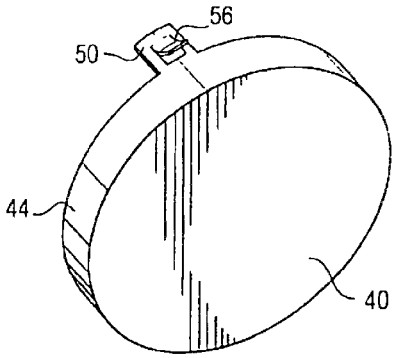
FIG. 7 is a perspective view of a metal cup of another contemplated configuration, as drawn similarly, before the metal cup is secured to a polymeric body.
Figure 8:
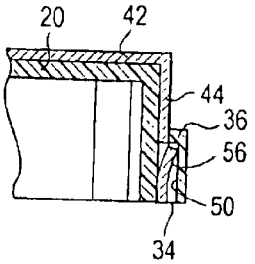
FIG. 8 is a fragmentary, cross-sectional detail of one unitary tab of the metal cup of FIG. 7, the unitary tab projecting through an associated slot in a polymeric body, whereby the metal cup is secured to the polymeric body in another contemplated manner.

In the alternative embodiment illustrated in FIG. 7, each unitary tab 50 does not have such a barbed portion but has a pierced portion 56 curving outwardly toward the circular plate 42. As illustrated in FIG. 8, the pierced portion 56 coacts with an inwardly projecting ledge 36, which is defined in the associated slot 34 in the polypropylene body 20, so as to permit said unitary tab 50 to be easily pushed into the associated slot 34 but not to be easily withdrawn unless a tool (not shown) is used to bend the pierced portion 56, whereby to secure the aluminum cup 60 to the polypropylene body 20.

Figure 9:
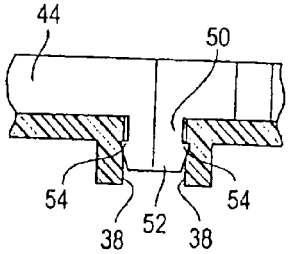
FIG. 9 is a fragmentary, cross-sectional detail of one unitary tab of a metal cup, which is similar to the metal cup of FIGS. 1 and 2, the unitary tab projecting through an associated slot in a polymeric body, whereby the metal cup is secured to the polymeric body in another contemplated manner.
Figure 10:
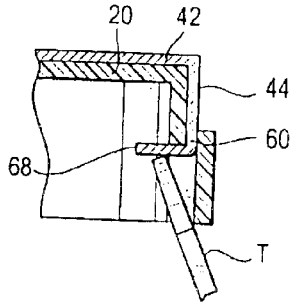
FIG. 10 is a fragmentary, cross-sectional detail of one unitary tab of a metal cup, which is similar to the metal cup of FIGS. 1 and 2, the unitary tab projecting through an associated slot in a polymeric body and being bent at its distal portion, whereby the metal cup is secured to the polymeric body in another contemplated manner. A tool being used to bend the distal portion of the unitary tab appears fragmentarily.

The alternative embodiment illustrated in FIG. 9 is similar to the preferred embodiment illustrated in FIGS. 2, 3, and 4, except that the associate slot 34 is longer and except that the barbed portion 52 of each unitary tab 50 is not pushed through the associate slot 34. Rather, the opposite barbs 54 tend to dig into the adjacent walls 38 of the associated slot 34, if an attempt is made to pull said unitary tab 50 from the associated slot 34, whereby to secure the aluminum cup 40 to the polypropylene body 20.

In the alternative embodiment illustrated in FIG. 7, in which each unitary tab 60 may or may not have such a barbed portion, each unitary tab 60 has a distal portion 68, which is bent inwardly by a tool T, under the polypropylene body 20, after the distal portion 68 has been pushed through the associated slot 34, whereby to secure the aluminum cup 60 to the polypropylene body 20.

In any of the aforenoted embodiments, the aluminum cup 50 is secured adhesively to the polypropylene body 20, at an interface 60 between the end face 24 and the circular plate 42.

What is claimed is:

1. A method of making a knob comprising the steps of:

(a) molding a polymeric material to provide a polymeric body, which has a boss having an end face and having an external wall extending between the end face and a recessed floor, (b) stamping and drawing a metal sheet or a metal strip to provide a metal cup, which is adapted to fit over the boss, with a circular plate adapted to cover the end face of the boss when the metal cup fits over the boss, and a skirt adapted to encompass the external wall of the boss when the metal cup fits over the boss, the skirt being unitary with the circular plate, and (c) fitting the metal cup over the boss so that the plate covers the end face of the boss, and so that the skirt encompasses the external wall of the boss and defines the outer face of said knob between said circular plate and said floor, and securing the metal cup to the polymeric body.

2. The method of claim 1, wherein the metal cup is provided in step (b) so that the skirt has a unitary tab projecting from the skirt and wherein in step (c) the unitary tab is caused to project through an associated slot in the floor.

3. The method of claim 2, wherein the metal cup is provided in step (b) so that the unitary tab has a barbed portion, which coacts with the polymeric body in step (c) to secure the metal cup to the polymeric body.

4. The method of claim 2, wherein the metal cup is provided in step (b) so that the unitary tab has a pierced portion, which coacts with the polymeric body in step (c) to secure the metal cup to the polymeric body.

5. The method of claim 2, wherein the metal cup is provided in step (b) so that the unitary tab has a distal portion, which is bent in step (c) to secure the metal cup to the polymeric body.

6. The method of claim 1, wherein the metal cup is provided in step (b) so that the skirt has unitary tabs projecting from the cylindrical skirt and wherein in step (c) each unitary tab is caused to project into an associated slot in the floor.

7. The method of claim 6, wherein the metal cup is provided in step (b) so that each unitary tab has a barbed portion, which coacts with the polymeric body in step (c) to secure the metal cup to the polymeric body.

8. The method of claim 6, wherein the metal cup is provided in step (b) so that each unitary tab has a pierced portion, which coacts with the polymeric body in step (c) to secure the metal cup to the polymeric body.

9. The method of claim 6, wherein the metal cup is provided in step (b) so that each unitary tab has a distal portion, which is bent under the polymeric body in step (c) to secure the metal cup to the polymeric body.

10. The method of any one of claims 1 through 9, wherein in step (c) the circular plate also is secured adhesively to the circular end face of the boss.

* * * * *